US007824186B2

(12) United States Patent
Zhao et al.

(10) Patent No.: US 7,824,186 B2
(45) Date of Patent: Nov. 2, 2010

(54) USB CONNECTOR AND USB DEVICE

(75) Inventors: Menglong Zhao, Shenzhen (CN); Bin Zhang, Shenzhen (CN)

(73) Assignee: Huawei Device Co., Ltd., Shenzhen (CN)

( * ) Notice: Subject to any disclaimer, the term of this patent is extended or adjusted under 35 U.S.C. 154(b) by 0 days.

(21) Appl. No.: 12/775,350

(22) Filed: May 6, 2010

(65) Prior Publication Data

US 2010/0221936 A1 Sep. 2, 2010

Related U.S. Application Data

(63) Continuation of application No. 12/391,612, filed on Feb. 24, 2009, which is a continuation of application No. PCT/CN2008/072951, filed on Nov. 5, 2008.

(30) Foreign Application Priority Data

Feb. 26, 2008 (CN) ..... 2008 1 0006325

(51) Int. Cl.
*H01R 39/00* (2006.01)

(52) U.S. Cl. ..... 439/13; 439/31; 439/936; 439/947

(58) Field of Classification Search ..... 439/8, 439/11, 13, 21, 31, 936, 947, 954
See application file for complete search history.

(56) References Cited

U.S. PATENT DOCUMENTS 5,658,170 A * 8/1997 Tan et al. ..... 439/607.41
5,938,476 A * 8/1999 Wu et al. ..... 439/607.57
5,941,733 A * 8/1999 Lai ..... 439/607.01
6,165,016 A * 12/2000 Lai ..... 439/607.41

(Continued)

FOREIGN PATENT DOCUMENTS

CN 1437089 A 8/2003

(Continued)

OTHER PUBLICATIONS

European Patent Office, Partial European Search Report in European Patent Application No. 10150216 (Mar. 23, 2010).

(Continued)

*Primary Examiner*—James Harvey
(74) *Attorney, Agent, or Firm*—Leydig, Voit & Mayer, Ltd.

(57) ABSTRACT

A USB connector for connecting with a USB female comprises a rotating shaft assembly which is capable of rotating, metal legs, a connecting line, and a substrate, wherein one end of the metal legs connects with one end of the connecting line, the metal legs are formed on a surface of the substrate, the connecting line is fixed to the surface of the substrate, and said rotating shaft assembly includes a rotating shaft and a rotating shaft sleeve, the rotating shaft sleeve is fixed on the surface of the substrate, and the rotating shaft is disposed in the rotating shaft sleeve and is capable of rotating relative to the rotating shaft sleeve. According to the USB connector and the USB device, the metal legs are formed on the surface of the substrate to ensure the connecting strength of the metal legs and reduce the thickness of the USB device.

17 Claims, 7 Drawing Sheets

U.S. PATENT DOCUMENTS

| | | | | |
|---|---|---|---|---|
| 6,544,075 | B1 | 4/2003 | Liao et al. | |
| 6,685,508 | B2 | 2/2004 | Zhu et al. | |
| 6,729,889 | B2 * | 5/2004 | Bauer | 439/67 |
| 6,893,267 | B1 * | 5/2005 | Yueh | 439/8 |
| 6,948,983 | B1 | 9/2005 | Peng et al. | |
| 7,001,192 | B1 | 2/2006 | Yeh et al. | |
| 7,025,595 | B1 * | 4/2006 | Chan et al. | 439/6 |
| 7,121,852 | B2 | 10/2006 | Ng et al. | |
| 7,172,428 | B2 * | 2/2007 | Huang | 439/11 |
| 7,234,963 | B1 | 6/2007 | Huang et al. | |
| 7,410,370 | B2 * | 8/2008 | Sprouse et al. | 439/95 |
| 7,674,117 | B2 * | 3/2010 | Sinnett et al. | 439/86 |
| 2004/0033727 | A1 | 2/2004 | Kao | |
| 2004/0048494 | A1 | 3/2004 | Yu | |
| 2004/0077216 | A1 * | 4/2004 | Tu | 439/607 |
| 2004/0081092 | A1 | 4/2004 | Rhee et al. | |
| 2004/0215966 | A1 | 10/2004 | Elteto | |
| 2005/0030952 | A1 | 2/2005 | El Masry et al. | |
| 2005/0070138 | A1 | 3/2005 | Chiou et al. | |
| 2006/0104298 | A1 | 5/2006 | McAlpine et al. | |
| 2006/0223369 | A1 | 10/2006 | Zheng | |
| 2007/0032101 | A1 | 2/2007 | Cuellar et al. | |
| 2007/0141915 | A1 | 6/2007 | Kim | |
| 2009/0215284 | A1 * | 8/2009 | Zhao et al. | 439/55 |

FOREIGN PATENT DOCUMENTS

| | | | |
|---|---|---|---|
| CN | 2583715 | Y | 10/2003 |
| CN | 2616942 | Y | 5/2004 |
| CN | 2738529 | Y | 11/2005 |
| CN | 2817114 | Y | 9/2006 |
| CN | 1859764 | A | 11/2006 |
| CN | 1874319 | A | 12/2006 |
| CN | 1941715 | A | 4/2007 |
| CN | 1979974 | A | 6/2007 |
| CN | 101009697 | A | 8/2007 |
| WO | WO 2006/082280 | A1 | 8/2006 |

OTHER PUBLICATIONS

State Intellectual Property Office of the People'S Republic of China, Examination Report in International Patent Application No. PCT/CN2008/072972 (Feb. 5, 2009).

* cited by examiner

USB CONNECTOR AND USB DEVICE

CROSS-REFERENCE TO RELATED APPLICATIONS

This application is a continuation of U.S. patent application Ser. No. 12/391,612, filed on Feb. 24, 2009, which is a continuation of International Application No. PCT/CN2008/072951, filed on Nov. 5, 2008, which claims priority to Chinese Patent Application No. 200810006325.5, filed on Feb. 26, 2008, all of which are hereby incorporated by reference in their entireties.

FIELD OF THE INVENTION

The invention relates to the field of communication, in particular to a USB (Universal Serial Bus) connector and a USB device.

BACKGROUND OF THE INVENTION

With the rapid development of communication technology, USB products play a more and more important role in people's life and work. Conventional USB products generally use special USB connectors. A special USB connector is provided at a front end of the USB products, and the USB products connect with a USB port through the USB connector.

During the implementation of the present invention, the inventor has found that with regard to the USB products commonly available in the market, its USB port connects longitudinally with the USB body. Therefore, the length of the USB port adds to the length of the USB body which makes the USB products longer. As a result, such USB products are neither easy to carry nor up to people's standards for exquisiteness and compactness.

SUMMARY OF THE INVENTION

The present invention provides a USB connector and a USB device. The USB connector has a reduced thickness, thereby decreasing the thickness of the USB device.

The present invention provides a USB connector for connecting with a USB female comprising a rotating shaft assembly which is capable of rotating, metal legs, a connecting line, and a substrate, wherein one end of the metal legs connects with one end of the connecting line, the metal legs are formed on a surface of the substrate, the connecting line is fixed to the surface of the substrate, and said rotating shaft assembly includes a rotating shaft and a rotating shaft sleeve, the rotating shaft sleeve is fixed on the surface of the substrate, and the rotating shaft is disposed in the rotating shaft sleeve and is capable of rotating relative to the rotating shaft sleeve.

The present invention also provides a USB device comprising a USB connector, a housing and a PCB (Printed Circuit Board) wherein the USB connector comprises metal legs, a connecting line, and a substrate, wherein one end of the metal legs connects with one end of the connecting line, the metal legs are formed on a surface of the substrate, the connecting line is fixed to the surface of the substrate, the USB connector is installed at an end of the housing by a rotating shaft assembly, the rotating shaft assembly includes a rotating shaft and a rotating shaft sleeve, the rotating shaft sleeve is fixed on the surface of the substrate, and the rotating shaft is disposed in the rotating shaft sleeve and is capable of rotating relative to the rotating shaft sleeve; the PCB is disposed inside a cavity of the housing and an end of the PCB connects with other end of the connecting line; and a receptacle for accommodating the USB connector is provided on a surface of the housing.

According to the USB connector and the USB device of the present invention, the metal legs are formed on the surface of the substrate so as to ensure the connecting strength of the metal legs. Since the size of the USB connector depends mainly on the substrate and as long as the thickness meets a requirement of inserting the USB connector into the USB female, the thickness of the USB connector and further, the thickness of the USB device are reduced without compromising the function of the USB connector. Compared with the conventional USB products, the thickness of the USB device according to the present invention is greatly reduced so that the USB device becomes smaller and easy to carry. It not only meets the people's requirement for exquisite and compact electronic products, but also improves the practicality and aesthetics of the USB device.

BRIEF DESCRIPTION OF THE DRAWINFS

FIG. 1 is an exploded schematic view of a USB connector according to a first embodiment of the present invention;

FIG. 2*a* is a first structural schematic view of the USB connector according to the first embodiment of the present invention;

FIG. 2*b* is a second structural schematic of the USB connector according to the first embodiment of the present invention;

Figure 5A:
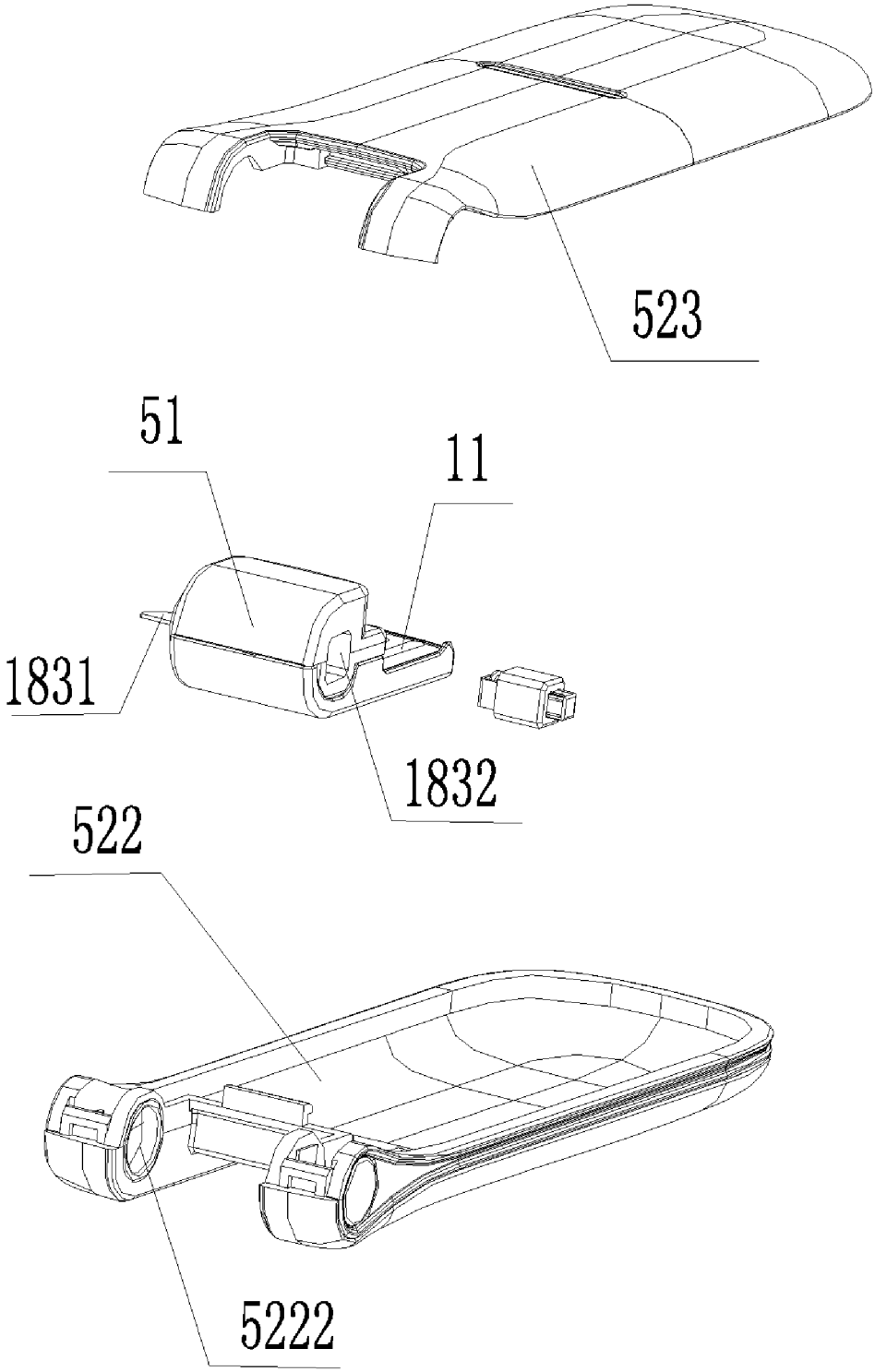
Figure 5B:
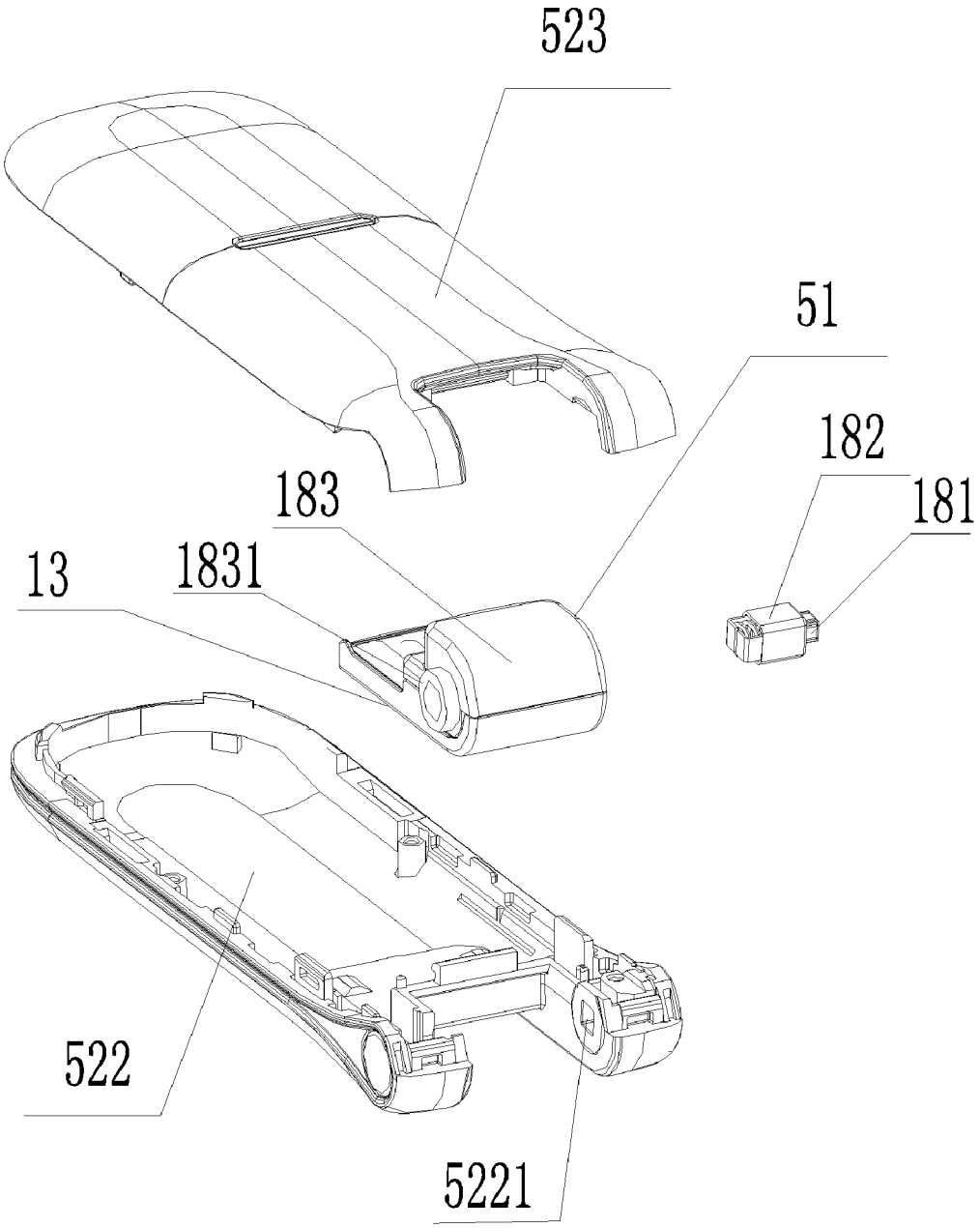
Figure 6:
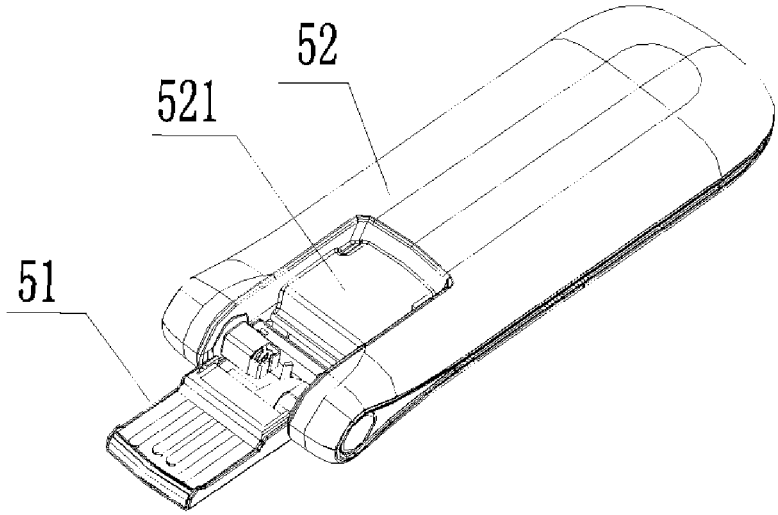
Figure 7:
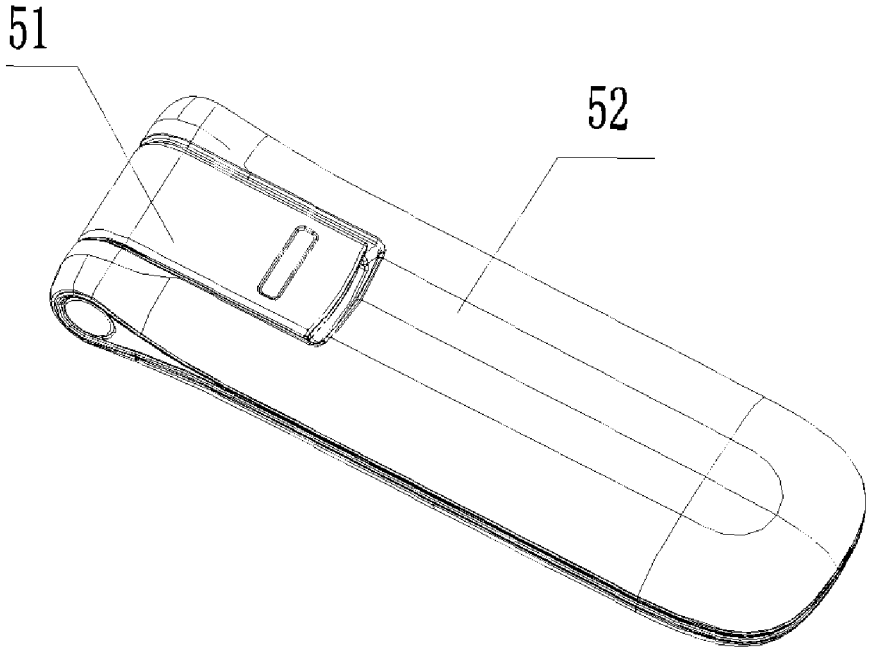
Figure 8:
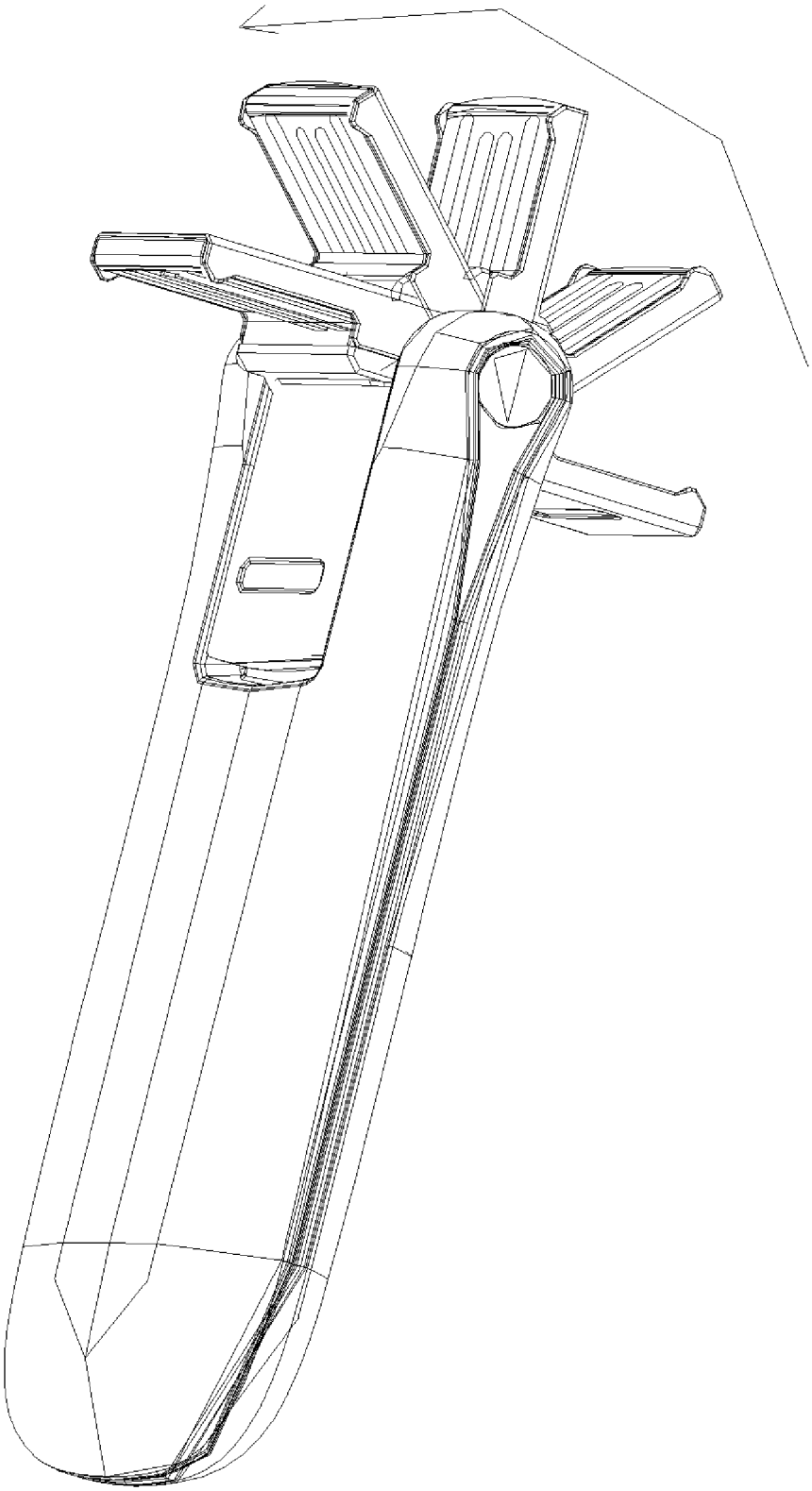

FIG. 5*a* is a first partially exploded schematic view of a USB device according to a second embodiment of the present invention;

FIG. 5*b* is a second partially exploded schematic view of the USB device according to the second embodiment of the present invention;

FIG. 6 is a first structural schematic view of the USB device according to the second embodiment of the present invention;

FIG. 7 is a second structural schematic view of the USB device according to the second embodiment of the present invention; and FIG. 8 is a schematic view of the USB connector in use in the USB device according to the second embodiment of the present invention.

DETAILED DESCRIPTION OF THE PREFERRED EMBODIMENTS

The present invention is detailed as below.

Figure 1:
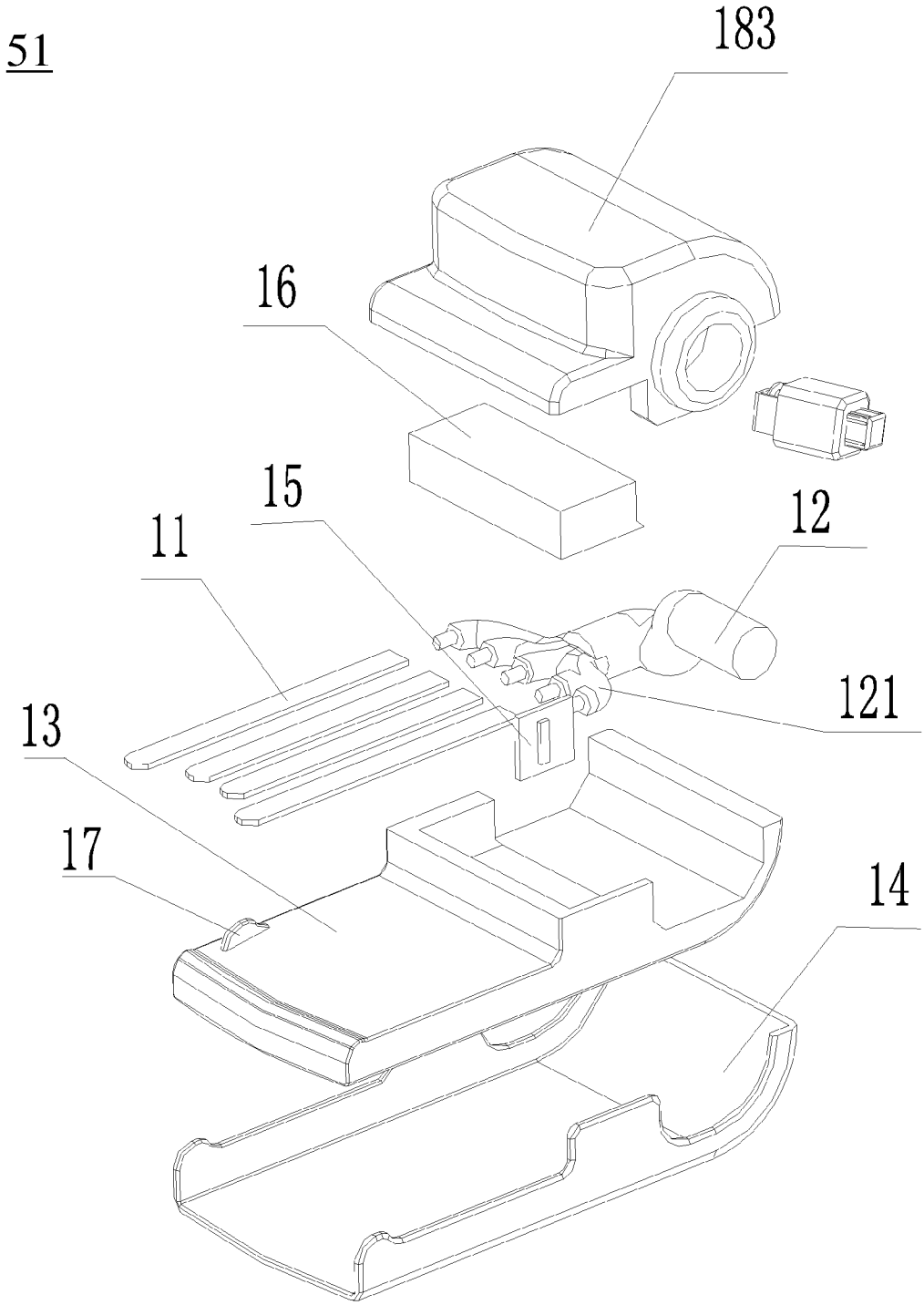

In the first embodiment, as shown in FIG. 1, a USB connector 51 for connecting with a USB female comprises metal legs 11, a connecting line 12 and a substrate 13. One end of the metal legs 11 connects with one end of the connecting line 12. Aother end of the connecting line 12 is used to connect with a PCB. The metal legs 11 are formed on a surface of the substrate 13. The connecting line 12 is fixed to the surface of the substrate 13. The thickness of the USB connector depends mainly on the thickness of the substrate 13. As long as the thickness of the substrate 13 meets a requirement of inserting the USB connector into the USB female, the thickness of the USB connector and further, the thickness of the USB device are reduced without compromising the function of the USB connector. Compared with the conventional USB products, the thickness of the USB device according to the present invention is greatly reduced, making the USB device smaller and easy to carry, which not only meets the people's requirement for exquisite and compact electronic products, but also improves the practicality and aesthetics of the USB device.

Furthermore, when the thickness of the substrate 13 is more than 2.45 mm, it may be difficult to insert the USB connector into the USB female. When the thickness of the substrate 13 is less than 2.2 mm, a gap between the USB connector and the USB female may be too large after insertion of the USB connector into the USB female. As a result, the stability of connection between the USB connector and the USB female is reduced. Therefore, the thickness of the substrate 13 is preferably in the range of 2.2 mm to 2.45 mm.

The metal legs 11 may be fixed to the surface of the substrate 13 by means of In Mold Decoration (IMD) molding or hot-inserting. Furthermore, in order to improve the connecting strength of the metal legs 11, slots may be set on the surface of the substrate 13 and the metal legs 11 are embedded in the surface of the substrate 13 so as to integrate with the substrate 13. Alternatively, the metal legs 11 may be formed on the surface of the substrate 13 by corrosion methods. For example, the metal legs 11 are formed by copper exposure on the surface of the substrate 13.

Further, in order to ensure the electrical connecting performance between the metal legs and the USB female, the surface of the metal legs 11 is not below the surface of the substrate 13. However, when the metal legs 11 exceed the surface of the substrate 13 by a height of more than 0.2 mm, it may be difficult to insert the USB connector into the USB female. So, the metal legs exceed the surface of the substrate 13 by the height of between 0 and 0.2 mm.

Further, in order to prolong the life of the USB connector, the surface of the metal legs 11 is plated with gold or silver to prevent the metal legs 11 from being oxidized by the contaminants in the air and prevent the metal legs 11 from being eroded when a user contacts them.

Further, in order to improve the Electro-Static Discharge (ESD) protection for the USB connector, the connecting line 12 also includes a ground terminal 121 for connecting with the ground of the PCB. A metal layer 14 is provided at other surface of the substrate 13 opposite to the metal legs 11. The metal layer 14 connects with the ground terminal 121 through a metal sheet 15 to realize the ESD protection. Further, the metal layer 14 may be a layer of stainless steel so as to improve its anticorrosion, thereby prolonging the life of the USB connector. Further, the metal sheet 15 extends through the substrate 13 so that one end of the metal sheet 15 connects with the ground terminal 121 of the connecting line 12 and the other end connects with the metal layer 14. Thus, the metal sheet 15 is invisible from the outside of the assembled USB connector, thereby improving the aesthetics of the USB connector. The metal layer 14 may be fixed to the substrate 13 by means of ultrasonic welding, bonding or other methods so that a good contact between the metal layer 14 and the metal sheet 15 is ensured.

Further, in order to enhance the stability of the USB connector, a retainer 16 for the connecting line is provided to cover the connecting line 12. The retainer 16 for the connecting line fixes the connecting line 12 onto the substrate 13. The retainer 16 for the connecting line may be made of plastic or hot-melt rubber by means of injection molding. The heated plastic or hot-melt rubber is filled into the gap between the connecting line 12 and the substrate 13 and forms the retainer 16 for the connecting line after cooling.

Further, in order to improve the practicability of the USB connector, a fool-proof structure 17 is provided on the surface of the substrate 13 to prevent the USB connector from being inserted reversely. When the user inserts the USB connector 51 into the USB female, the surface with the fool-proof structure 17 is set upward so as to form a good contact between the metal legs 11 and the USB female 1, thereby preventing the USB connector from being inserted reversely into the USB female and from causing a short circuit or no function by means of the fool-proof structure 17. Since a gap is formed between the surface of the substrate 13 and the inner wall of the USB female when the substrate 13 engages with the USB female, the fool-proof structure 17 may be accommodated into the gap. Thus, a universal USB female may enageg with the USB connector 51 according to this embodiment. In addition, the fool-proof structures 17 can be disposed symmetrically or asymmetrically on the surface of the substrate 13. Preferably, the fool-proof structures 17 are disposed symmetrically on the surface of the substrate 13 to improve the aesthetics of the USB connector and facilitate manufacturing. Alternatively, the fool-proof structures 17 may be the projections disposed on one side of the surface of the substrate 13 or symmetrically on both sides of the surface of the substrate 13.

Figure 2A:
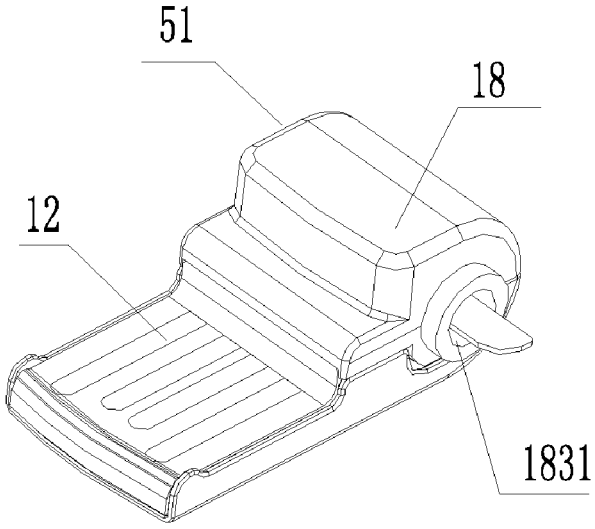
Figure 3:
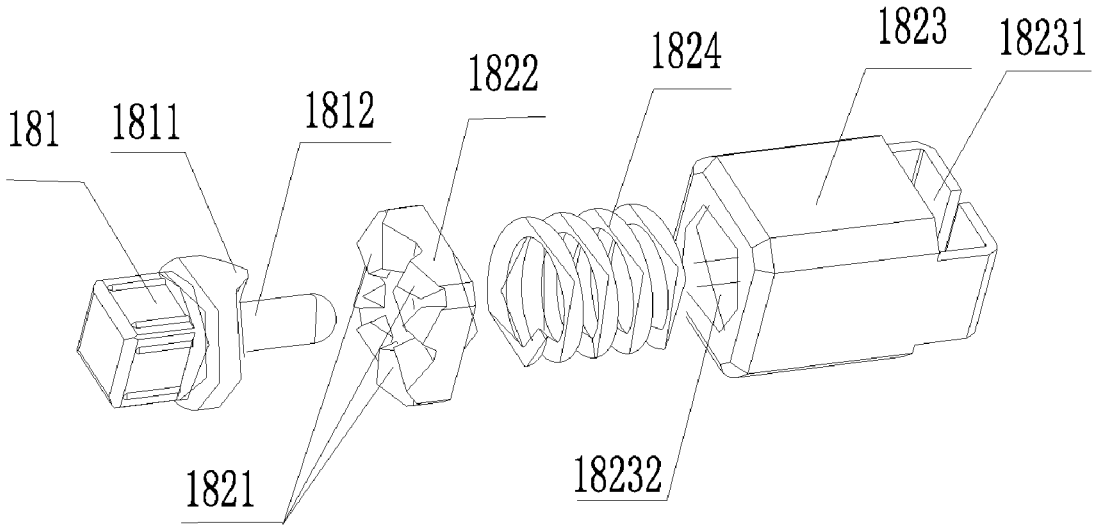
FIG. 3 is an exploded schematic of a rotating shaft assembly shown in FIG. 1.
Figure 4:
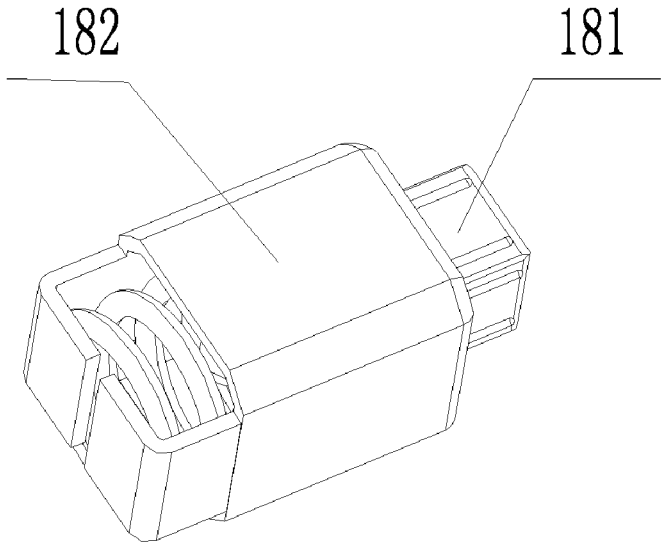
FIG. 4 is a structural schematic of the rotating shaft assembly shown in FIG. 3.

Further, in order to ensure flexibility when the USB connector is in use, as shown in FIG. 2*a*, a rotating shaft assembly 18 is fixed to the surface of the substrate 13. The rotating shaft assembly 18 may be fixed to the surface of the substrate 13 by means of ultrasonic welding, bonding and so on. See FIGS. 5*a* and 5*b*, when the USB connector 51 is installed to other components by the rotating shaft assembly 18 to form a USB device such as a U-disk or a wireless network adaptor, the USB connector 51 may rotate relative to other components by means of the rotating shaft assembly 18. Further, see FIGS. 3 and 4, the rotating shaft assembly 18 may include a rotating shaft 181 and a rotating shaft sleeve 182. The rotating shaft sleeve 182 is fixed on the surface of the substrate 13 and the rotating shaft 181 may rotate in the rotating shaft sleeve 182. The rotating shaft 181 has a first positioning structure 1811 thereon, and the rotating shaft sleeve 182 has a second positioning structure 1821 therein. The first positioning structure 1811 works with the second positioning structure 1821 to realize the positioning function. The rotating shaft assembly 18 with the first positioning structure 1811 and the second positioning structure 1821 could realize positioning when the USB connector 51 is rotating. For example, the USB connector 51 may stop when rotating every 45° or every 90°. The first positioning structure 1811 and the second positioning structure 1821 may adopt the conventional positioning structure. For example, the first positioning structure 1811 is elastic projections, and the second positioning structure 1821 is positioning holes or positioning grooves distributed regularly within the rotating shaft sleeve 182 according to the positioning requirements when the USB connector 51 rotates. When the rotating shaft 181 rotates relative to the rotating shaft sleeve 182 and the first location structure 1811 meets the second location structure 1821, the elastic projections insert into the positioning holes or the positioning grooves, thereby stopping and positioning the USB connector 51. When a force for continuously rotating the USB connector 51 has effect on the USB connector 51, the elastic projections deform under extrusion of the inner wall of the positioning holes or the positioning grooves and disengage from the positioning holes, so that the USB connector may continue to rotate in an original direction or an opposite direction.

Figure 2B:
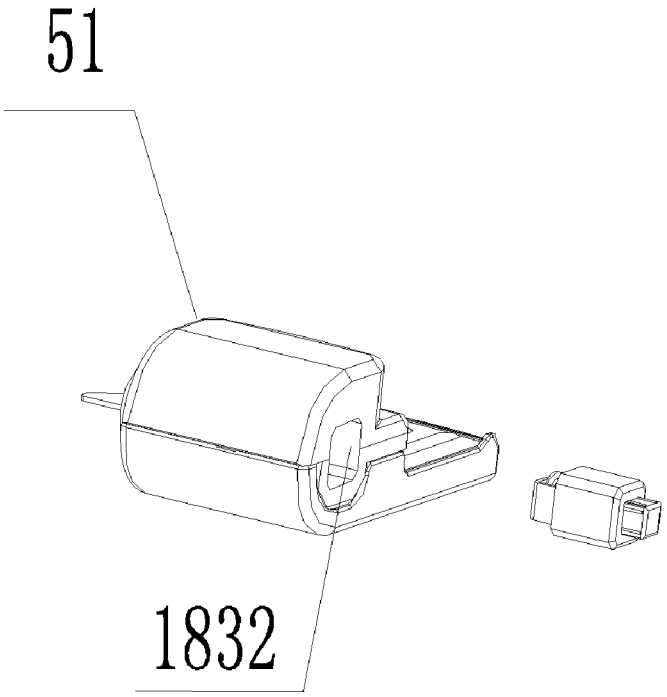

In order to facilitate mounting the USB connector 51 to other components to form the USB device, the rotating shaft assembly 18 may also include a rotating shaft support 183. Unlike the way in which the rotating shaft sleeve 182 is fixed on the surface of the substrate 13, the rotating shaft assembly 18 with the rotating shaft support 183 is fixed on the surface of the substrate 13 by the rotating shaft support 183. As shown in FIGS. 2*a* and 2*b*, the rotating shaft assemble provided with a rotating shaft support is fixed on the surface of the substrate in the following way: the rotating shaft support 183 is nested in the surface of the substrate 13, a portion of the rotating shaft support 183 which comes into contact with the surface of the substrate 13 is fixedly connected, a first support hole 1831 and a second support hole 1832 are provided at either side of the rotating shaft support 183 respectively, the other end of the connecting line 12 passes through the first support hole 1831 to connect with the PCB; the rotating shaft sleeve 182 passes through the second support hole 1832. As shown in FIG. 1, five wires are twisted together to form the connecting line 12, one end of the five wires connects with the metal legs 11 and the other end passes through the first support hole 1831. As shown in FIG. 6, the USB connector has been installed to other components to form a USB device, the USB connector may rotate clockwise or anti-clockwise relative to other components by means of the rotating shaft assembly 18. During rotation, the connecting line 12 twists or untwists like a fried-dough-twist. Further, the rotating shaft sleeve 182 includes a first sleeve part 1822, a second sleeve part 1823 and a elastic part 1824. The first sleeve part 1822 has a through hole thereon. The second sleeve part 1823 has a cavity 28231 therein and a hole 18232 formed in the side wall of the second sleeve part 1823. The elastic part 1824 may be a spring and so on. The rotating shaft 181 comprises a elastic square head 1811 and a trailing end 1812 which connects with the elastic square head. The trailing end 1812 passes through the first sleeve part and cooperates with the second sleeve part 1823 of the rotating shaft sleeve 182 to press the elastic part 1824. After the trailing end 1812 is fitted into the cavity 18231 of the second sleeve part, the elastic deformation of the elastic part 1824 resumes so that the elastic square head 1811 is ejected out of the hole 18232 of the side wall of the second sleeve part.

In the second embodiment, as shown in FIG. 5*a*, FIGS. 5*b* and 6, a USB device such as a U-disk or a wireless network adaptor and so on comprises the USB connector 51 as described in the first embodiment, a housing 52 and a PCB. The same parts as those in the first embodiment are indicated by the same reference numerals as those in the first embodiment. The USB connector 51 comprises metal legs 11, a connecting line 12, a substrate 13 and a rotating shaft assembly 18. One end of the metal legs 11 connects with one end of the connecting line 12. The metal legs 11 are formed on the surface of the substrate 13. The rotating shaft assembly 18 is fixed to the surface of the substrate 13. The USB connector is installed at the end of the housing 52 by the rotating shaft assembly 18. The PCB is disposed inside the cavity of the housing and the end of the PCB connects with other end of the connecting line 12. A receptacle 521 for accommodating the USB connector is provided in the surface of the housing.

In order to facilitate assembling, the housing generally includes a first housing 522 and a second housing 523. The first and second housings join together to form a cavity in which the PCB is disposed. When assembled, each of both ends of the USB connector is fitted into one corresponding hole which is provided at either side of one end of the first housing. The USB connector is thus installed at one end of the first housing by the rotating shaft assembly 18; then the first housing is covered with the second housing to form the USB device. The USB connector may rotate with respect to the housing and ensures the continuity of the connecting line 12. Mounting the USB connector at one end of the first housing by the rotating shaft assembly 18 may be implemented in the following ways: the rotating shaft assembly comprises a rotating shaft sleeve and a rotating shaft, the rotating shaft may rotate in the shaft sleeve, the rotating shaft sleeve is fixed to the surface of the substrate, and each of both ends of the rotating shaft is fitted into the corresponding hole of either side of the one end of the first housing; alternatively, as shown in FIGS. 5*a* and 5*b*, the rotating shaft assembly 18 comprises a rotating shaft sleeve 182, a rotating shaft 181 and a rotating shaft support 183; the rotating shaft support 183 is fixed to the surface of the substrate 13; the rotating shaft sleeve 182 passes from inside through the second support hole 1832 at one side of the rotating shaft support 183 and a hole 5221 formed at one side of the one end of the first housing; the rotating shaft 181 may rotate in the rotating shaft sleeve 182; a first supporting portion which is coaxial with the rotating shaft 181 is provided on the rotating shaft support 183, and a second supporting portion corresponding to the first supporting portion is provided at the first housing; the first supporting portion cooperates with the second supporting portion so as to connect pivotably the USB connector with the first housing. The first supporting portion may be a projection 1831 protruding outward from the rotating shaft support 183, and the second supporting portion may be a hole 5222 formed at other side of the one end of the first housing, and the projection is nested into the hole. Alternatively, the first supporting portion may be a groove formed on the rotating shaft support 183, the second supporting portion may be a projection protruding inward from other side of the one end of the first housing, and the projection is nested into the groove.

The receptacle 521 on the surface of the housing accommodates the USB connector in such a way that the metal legs face to the receptacle. Thus, when the USB device is unused, the USB connector is accommodated into the receptacle and the metal legs face to the receptacle. Viewed from outside of the USB device, only the other surface of the substrate opposite to the metal legs exposes to the outside, thereby preventing the metal legs from being contaminated or damaged by the environment.

Further, as shown in FIG. 7, from the perspective of aesthetics and psychology, there is a smooth transition between an outside surface of the USB connector and an outside surface of the housing when the USB connector is accommodated in the receptacle. Thus, when the USB device is unused, the USB connector and the housing appear to have the same surface so that the appearance of the USB device is aesthetic, simple and smooth, thereby meeting the user's requirements for exquisite products.

As shown in FIG. 8, in practice, the USB connector may rotate with respect to the housing in a direction or in an opposite direction so that it may rotate freely and is easy to store. The USB device according to the present invention eliminates the disadvantage of conventioanl USB device in which the USB connector is arranged in a line with the housing and can not be bent.

The description above is merely a special embodiment of the present invention. It is noted that it is possible for a person skilled in the art to make various modifications and variations without departing from the principles of the present invention and those modifications and variations will fall within the scope of the present invention.

The invention claimed is:

1. A USB connector for connecting with a USB female, comprising: a rotating shaft assembly which is capable of rotating, a plurality of metal legs, a connecting line, and a substrate, wherein one end of the metal legs connects with one end of the connecting line, the metal legs are formed on a surface of the substrate, the connecting line is fixed to the surface of the substrate, and said rotating shaft assembly includes a rotating shaft and a rotating shaft sleeve, the rotating shaft sleeve is fixed on the surface of the substrate, and the rotating shaft is disposed in the rotating shaft sleeve and is capable of rotating relative to the rotating shaft sleeve.

2. The USB connector according to claim 1, wherein the rotating shaft has a first positioning structure thereon, the rotating shaft sleeve has a second positioning structure therein, and the first positioning structure works with the second positioning structure to realize the positioning function.

3. The USB connector according to claim 1, wherein a metal layer is provided at another surface of the substrate opposite to the metal legs, and the metal layer has a U-shaped cross-section which is substantially perpendicular to the extending direction of the metal legs.

4. The USB connector according to claim 3, wherein the connecting line further comprises a ground terminal, a metal sheet extends through the substrate so that one end of the metal sheet connects with the ground terminal of the connecting line and the other end connects with the metal layer.

5. The USB connector according to claim 1, wherein the USB connector further comprising a fool-proof structure to prevent the USB connector from being inserted reversely, the fool-proof structures is first projections provided on the surface of the substrate.

6. The USB connector according to claim 1, wherein the USB connector further comprises a fool-proof structure to prevent the USB connector from being inserted reversely, the fool-proof structures is second projections formed by extending the two flanks of the metal layer away from the undersurface of the metal layer.

7. The USB connector according to claim 6, wherein the second projections are higher than the face of the substrate, and the second projections are at a longitudinal end of the metal layer which is near the metal legs.

8. A USB device comprising a USB connector, a housing and a Printed Circuit Board (PCB), wherein the USB connector comprises metal legs, a connecting line, and a substrate, wherein one end of the metal legs connects with one end of the connecting line, the metal legs are formed on a surface of the substrate, the connecting line is fixed to the surface of the substrate, the USB connector is installed at an end of the housing by a rotating shaft assembly, the rotating shaft assembly includes a rotating shaft and a rotating shaft sleeve, the rotating shaft sleeve is fixed on the surface of the substrate, and the rotating shaft is disposed in the rotating shaft sleeve and is capable of rotating relative to the rotating shaft sleeve;

the PCB is disposed inside a cavity of the housing and an end of the PCB connects with other end of the connecting line; and a receptacle for accommodating the USB connector is provided on a surface of the housing.

9. The USB device according to claim 8, wherein the receptacle accommodates the USB connector in such a way that the metal legs face to the receptacle, and there is a smooth transition between an outside surface of the USB connector and an outside surface of the housing when the USB connector is accommodated in the receptacle.

10. The USB device according to claim 8, wherein the USB connector further comprises a fool-proof structure to prevent the USB connector from being inserted reversely, the fool-proof structures is first projections provided on the surface of the substrate.

11. The USB device according to claim 8, wherein the USB connector further comprises a fool-proof structure to prevent the USB connector from being inserted reversely, the fool-proof structures is second projections formed by extending the two flanks of the metal layer away from the undersurface of the metal layer.

12. The USB device according to claim 11, wherein the second projections are higher than the face of the substrate, and the second projections are at a longitudinal end of the metal layer which is near the metal legs.

13. The USB device according to claim 8, wherein the rotating shaft has a first positioning structure thereon, the rotating shaft sleeve has a second positioning structure therein, and the first positioning structure works with the second positioning structure to realize the positioning function.

14. The USB device according to claim 8, wherein each of both ends of the USB connector is fitted into one corresponding hole which is provided at either side of one end of a first housing of the housing, the USB connector is installed at one end of the first housing by the rotating shaft assembly, and the first housing is covered with a second housing.

15. The USB device according to claim 8, wherein a metal layer is provided at another surface of the substrate opposite to the metal legs, and the metal layer has a U-shaped cross-section which is substantially perpendicular to the extending direction of the metal legs.

16. The USB connector according to claim 8, wherein the connecting line further comprises a ground terminal, a metal sheet extends through the substrate so that one end of the metal sheet connects with the ground terminal of the connecting line and the other end connects with the metal layer.

17. The USB device according to claim 8, wherein the USB device is a wireless network adaptor.

* * * * *

US007824186C1

(12) EX PARTE REEXAMINATION CERTIFICATE (9695th)

United States Patent
Zhao et al.

(10) Number: US 7,824,186 C1
(45) Certificate Issued: Jun. 4, 2013

(54) USB CONNECTOR AND USB DEVICE

(75) Inventors: Menglong Zhao, Shenzhen (CN); Bin Zhang, Shenzhen (CN)

(73) Assignee: Huawei Device Co., Ltd., Bantian, Longgang District, Shenzhen, Guangdong (CN)

Reexamination Request:
No. 90/009,966, Nov. 2, 2011

Reexamination Certificate for:

| | |
|---|---|
| Patent No.: | **7,824,186** |
| Issued: | **Nov. 2, 2010** |
| Appl. No.: | **12/775,350** |
| Filed: | **May 6, 2010** |

Related U.S. Application Data

(63) Continuation of application No. 12/391,612, filed on Feb. 24, 2009, now Pat. No. 7,828,599.

(30) Foreign Application Priority Data

Feb. 26, 2008 (CN) ..... 2008 1 0006325

(51) Int. Cl.
*H01R 39/00* (2006.01)

(52) U.S. Cl.
USPC ..... 439/13; 439/31; 439/936; 439/947

(58) Field of Classification Search
None
See application file for complete search history.

(56) References Cited

To view the complete listing of prior art documents cited during the proceeding for Reexamination Control Number 90/009,966, please refer to the USPTO's public Patent Application Information Retrieval (PAIR) system under the Display References tab.

*Primary Examiner* — Leonardo Andujar

(57) ABSTRACT

A USB connector for connecting with a USB female comprises a rotating shaft assembly which is capable of rotating, metal legs, a connecting line, and a substrate, wherein one end of the metal legs connects with one end of the connecting line, the metal legs are formed on a surface of the substrate, the connecting line is fixed to the surface of the substrate, and said rotating shaft assembly includes a rotating shaft and a rotating shaft sleeve, the rotating shaft sleeve is fixed on the surface of the substrate, and the rotating shaft is disposed in the rotating shaft sleeve and is capable of rotating relative to the rotating shaft sleeve. According to the USB connector and the USB device, the metal legs are formed on the surface of the substrate to ensure the connecting strength of the metal legs and reduce the thickness of the USB device.

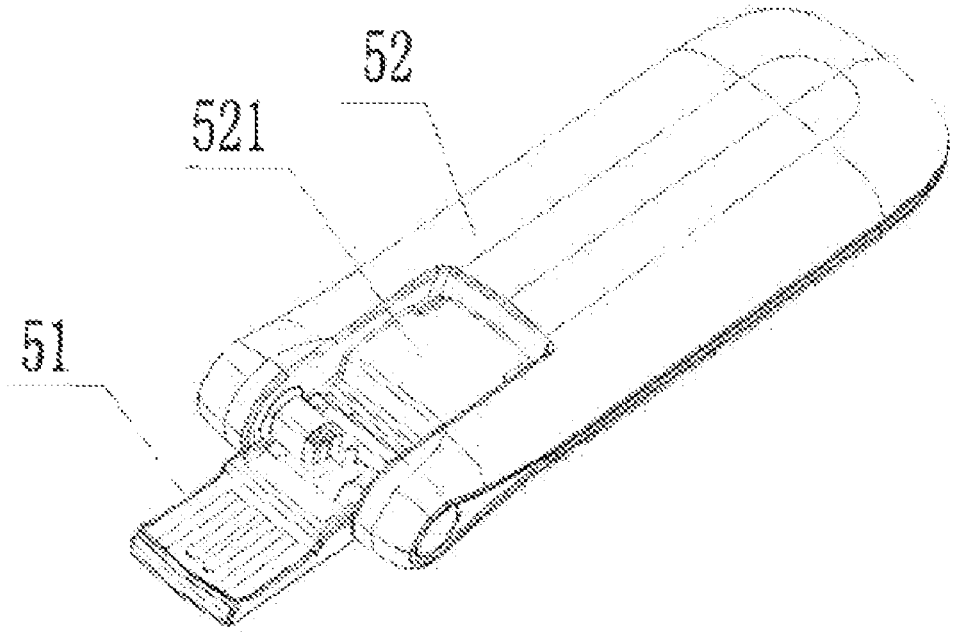

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, lines 7-9:

This application is a continuation of U.S. patent application Ser. No. 12/391,612, filed on Feb. 24, 2009 *now U.S. Pat. No. 7,828,599*, [which is a continuation of International Application No. PCT/CN2008/072951, filed on Nov. 5, 2008,] which claims priority to Chinese Patent Application No. 200810006325.5, filed on Feb. 26, 2008, all of which are hereby incorporated by reference in their entireties.

AS A RESULT OF REEXAMINATION, IT HAS BEEN DETERMINED THAT:

The patentability of claims 8, 9 and 11-17 is confirmed.

Claims 4 and 5 are cancelled.

Claim 1 is determined to be patentable as amended.

Claims 2-3, 6 and 7, dependent on an amended claim, are determined to be patentable.

New claims 18-20 are added and determined to be patentable.

Claim 10 was not reexamined.

1. A USB connector for connecting with a USB female, comprising: a rotating shaft assembly which is capable of rotating, a plurality of metal legs, a connecting line, and a substrate, wherein one end of the metal legs connects with one end of the connecting line, the metal legs are formed on [a] *an up facing* surface of the substrate, the connecting line is fixed to the *up facing* surface of the substrate, and said rotating shaft assembly includes a rotating shaft and a rotating shaft sleeve, the rotating shaft sleeve is fixed on [the surface of] the substrate *through the up facing surface*, and the rotating shaft is disposed in the rotating shaft sleeve and is capable of rotating relative to the rotating shaft sleeve.

*18. A USB connector for connecting with a USB female, comprising:*

*a rotating shaft assembly which is capable of rotating, a plurality of metal legs, a connecting line, and a substrate, wherein one end of the metal legs connects with one end of the connecting line, the metal legs are formed on a surface of the substrate, the connecting line is fixed to the surface of the substrate, and said rotating shaft assembly includes a rotating shaft and a rotating shaft sleeve, the rotating shaft sleeve is fixed on the surface of the substrate, and the rotating shaft is disposed in the rotating shaft sleeve and is capable of rotating relative to the rotating shaft sleeve,*

*wherein a metal layer is provided at another surface of the substrate opposite to the metal legs, and the metal layer has a U-shaped cross-section which is substantially perpendicular to the extending direction of the metal legs, and*

*wherein the connecting line further comprises a ground terminal, a metal sheet extends through the substrate so that one end of the metal sheet connects with the ground terminal of the connecting line and the other end connects with the metal layer.*

*19. A USB connector for connecting with a USB female, comprising:*

*a rotating shaft assembly which is capable of rotating, a plurality of metal legs, a connecting line, and a substrate, wherein one end of the metal legs connects with one end of the connecting line, the metal legs are formed on a surface of the substrate, the connecting line is fixed to the surface of the substrate, and said rotating shaft assembly includes a rotating shaft and a rotating shaft sleeve, the rotating shaft sleeve is fixed on the surface of the substrate, and the rotating shaft is disposed in the rotating shaft sleeve and is capable of rotating relative to the rotating shaft sleeve,*

*wherein the connecting line further comprises a ground terminal, a metal sheet extends through the substrate so that one end of the metal sheet connects with the ground terminal of the connecting line and the other end connects with the metal layer.*

*20. A USB connector for connecting with a USB female, comprising:*

*a rotating shaft assembly which is capable of rotating, a plurality of metal legs, a connecting line, and a substrate, wherein one end of the metal legs connects with one end of the connecting line, the metal legs are formed on a surface of the substrate, the connecting line is fixed to the surface of the substrate, and said rotating shaft assembly includes a rotating shaft and a rotating shaft sleeve, the rotating shaft sleeve is fixed on the surface of the substrate, and the rotating shaft is disposed in the rotating shaft sleeve and is capable of rotating relative to the rotating shaft sleeve,*

*wherein the USB connector further comprising a fool-proof structure to prevent the USB connector from being inserted reversely, the fool-proof structures is first projections provided on the surface of the substrate.*

* * * * *